US007334714B2

(12) United States Patent
Brown

(10) Patent No.: US 7,334,714 B2
(45) Date of Patent: Feb. 26, 2008

(54) WEARABLE PERSONAL ITEM CARRIER

(75) Inventor: Worth Brown, Chicago, IL (US)

(73) Assignee: CallKeeper Company, Inc., Chicago, IL (US)

( * ) Notice: Subject to any disclaimer, the term of this patent is extended or adjusted under 35 U.S.C. 154(b) by 407 days.

(21) Appl. No.: 10/715,772

(22) Filed: Nov. 17, 2003

(65) Prior Publication Data

US 2004/0155084 A1 Aug. 12, 2004

Related U.S. Application Data

(63) Continuation-in-part of application No. 10/298,809, filed on Nov. 18, 2002.

(51) Int. Cl.
*A45F 3/02* (2006.01)
*A45C 13/30* (2006.01)

(52) U.S. Cl. ..... 224/623; 224/625; 224/600; 224/626

(58) Field of Classification Search ..... 224/623, 224/625, 639, 651, 624, 600, 579, 578, 175, 224/626, 605
See application file for complete search history.

(56) References Cited

U.S. PATENT DOCUMENTS

| | | | | |
|---|---|---|---|---|
| 4,295 A | | 11/1845 | Eames | |
| 197,186 A | | 11/1877 | Van Keuren | |
| 844,707 A | | 2/1907 | Barker | |
| 1,094,188 A | | 4/1914 | Ayres | |
| 1,683,427 A | | 9/1928 | Turner | |
| D166,401 S | | 4/1952 | Mackie | |
| 3,862,709 A | * | 1/1975 | Roshaven | 224/264 |
| 4,046,296 A | | 9/1977 | McGhee | |
| 4,750,652 A | * | 6/1988 | Grant | 224/627 |
| 5,020,673 A | * | 6/1991 | Adams | 206/581 |
| 5,263,618 A | * | 11/1993 | Talavera | 224/148.5 |
| 5,358,159 A | | 10/1994 | Lundie, Jr. | |
| D370,776 S | | 6/1996 | Frey | |
| 5,533,655 A | | 7/1996 | Duque | |
| 5,586,704 A | | 12/1996 | Alexander et al. | |
| 5,653,336 A | * | 8/1997 | Buonaiuto et al. | 206/320 |
| 5,653,367 A | | 8/1997 | Abramson | |
| 5,713,406 A | * | 2/1998 | Drury | 150/132 |
| 5,746,365 A | * | 5/1998 | Scott | 224/676 |
| D396,553 S | | 8/1998 | Mecham et al. | |
| 5,813,584 A | | 9/1998 | Mauser | |
| 6,182,878 B1 | * | 2/2001 | Racca | 224/605 |
| D438,705 S | | 3/2001 | Steurer | |
| 6,209,769 B1 | * | 4/2001 | Seals et al. | 224/583 |

(Continued)

*Primary Examiner*—Nathan J. Newhouse
*Assistant Examiner*—Lester L. Vanterpool
(74) *Attorney, Agent, or Firm*—Bell, Boyd & Lloyd, LLP

(57) ABSTRACT

An assembly that enables a person to flexibly position and hold in place an item of personal property for which the user desires to have frequent and immediate access is provided. The assembly includes a strap that extends diagonally along the front of the user, over one shoulder of the user, and diagonally across the back of the user, wherein the strap has end portions that come together near the person's midsection and attach, via a mechanism, to an item of apparel worn by the user. The strap can also be opened to extend around a person's waist or midsection. A carrier slideably engages the strap for example at a portion of the strap along the front side of the user. The carrier houses one or more personal items, such as a cell phone.

22 Claims, 9 Drawing Sheets

U.S. PATENT DOCUMENTS

D447,864 S 9/2001 Casparian
6,283,350 B1 9/2001 Gottmeier et al.
6,305,535 B1 10/2001 Fair
6,315,179 B1 * 11/2001 Hillis ..... 224/268
6,390,346 B1 5/2002 Thomas
6,478,205 B1 * 11/2002 Fujihashi ..... 224/675

* cited by examiner

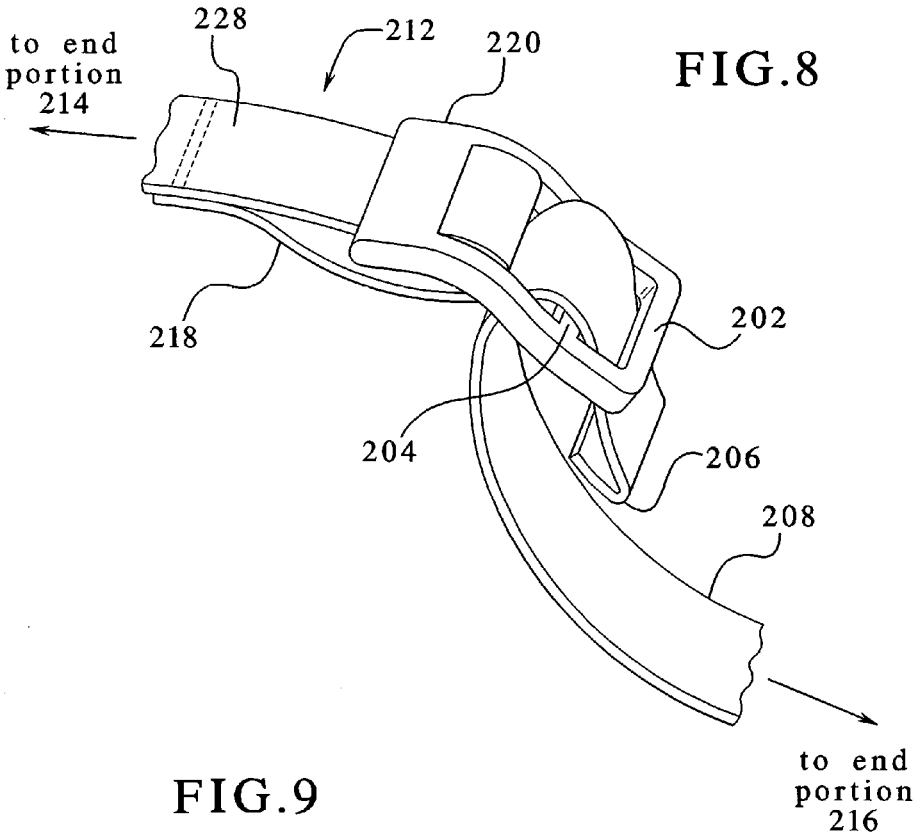
FIG.8
FIG.9
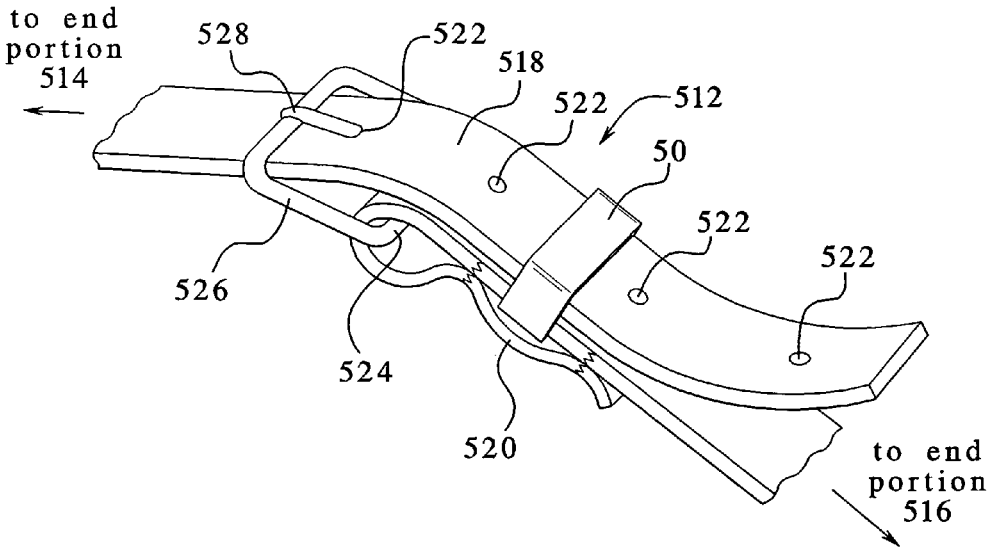

WEARABLE PERSONAL ITEM CARRIER

PRIORITY CLAIM

This application is a continuation-in-part and claims the benefit of U.S. patent application Ser. No. 10/298,809, filed Nov. 18, 2002, entitled "Wearable Carrier for Holding a Personal Item."

BACKGROUND OF THE INVENTION

This invention relates generally to devices for transporting personal items and more particularly to a wearable device for holding items of personal property, such as cell phones. The use the cell phones has increased at an extraordinary rate over the past decade. Approximately fifty percent of the population of the United States has a cell phone. It is common to see people, male or female, young or old, at play or at profession, at school or in the business world, using a cell phone in public, in a vehicle or in other places. People use cell phones to conduct business, to talk to friends, to keep in touch with family members and perform virtually any task that can be performed by a business phone or home phone.

In a like manner, the use of portable compact disc players as well as other types of electronic devices, such as digital music players (MP3, miniature disk and the like), hand-held email and/or internet access devices, have also become very pervasive in society. People enjoy listening to music while walking from the train to work, while jogging or performing virtually any exercise in or out of the home. Of course, along with these types of electronic devices, people transport other items of personal property on a regular basis, such as makeup, a comb or hair brush, address books, sunglasses as well as other items.

In each of these instances, it is obviously awkward for a person to have to hold in their hand one or more of the above mentioned items for a prolonged period of time. For this reason, various devices have been developed that allow a person to more conveniently transport personal items. Students often use backpacks to transport books and other school items, wherein the backpacks usually contain smaller pockets for storing the items listed above. It is also common for people to carry these types of personal items in a briefcase. Still further, women commonly use purses to carry makeup and other items, such as cell phones.

A need has arisen however for people to have more immediate access to certain items than is typically provided by a backpack, briefcase or purse. When a person receives a cell phone call, it is cumbersome for the person to open up a briefcase, purse or backpack, find the phone and answer it before the person calling hangs up. A person using a portable compact disc player may find it cumbersome to have headphone wires extending from and pulling on the person's head because they run to the disc player located in a backpack or briefcase.

People often desire to keep certain items, such as makeup or cigarettes in a place that is readily and immediately accessible. A backpack, briefcase or purse does not in many instances provide sufficient accessibility. Further, a backpack, briefcase or purse may not provide the level of security or access for carrying important items, such as wallets, medicine, passports and the like, for example, while in an airport or traveling abroad.

Cell phones, beepers and the like have in the past been attached removably to one's pants or belt. This arrangement has a number of drawbacks. First, the device and in particular the cell phone, which in many cases includes an antenna that sticks upwardly from the top of the cell phone, jabs one's stomach area and ribs when fixed to one's waistline. The device can be even more uncomfortable when one sits or bends at the waistline or for overweight people. Cell phones that swivel with respect to a person's belt have been provided but tend to come loose easily from the belt.

The devices can also act to restrict the movement of a person who tries to avoid the discomfort caused by the device being stored at or near the waistline. Further, due to the regular activity that occurs at or near the waistline, such as, twisting or sitting, removing items from a pocket, bumping into other people, fixtures and other items that may crowd a person, the current method of holding a cell phone or other type of device on the pants or belt of a person is prone to causing the device to become damaged or dislodged. Cell phones also pose a danger to people when used by a person who is driving.

Elderly people, people confined to a wheelchair and people with medical ailments may have an increased need to be close to a readily accessible telephone. Cell phones enable people in such conditions to travel safely outside the range of a cordless telephone. It would therefore be beneficial to make cell phones more accessible to people with such needs.

For each of the foregoing reasons, there is a need for a device, which is comfortable to use, and which allows ready access to personal items.

SUMMARY OF THE INVENTION

The present invention provides a device that enables the user to flexibly position and hold in place an item of personal property for which the user desires to have frequent and ready access. The device includes a strap that extends diagonally along the front of the user, over one shoulder of the user, and diagonally across the back of the user, wherein the strap has end portions that come together and attach near the waistline to an item of apparel worn by the user. A carrier or caddy, slideably engages the strap, for example at a portion of the strap along the front side of the user.

The slideable caddy in one embodiment defines apertures that are sized to frictionally engage the strap, so that the user is required to exert a force on the caddy that is greater than forces normally exerted on the caddy due to gravity or via the action of the user either walking, jogging or running. The caddy holds itself in place after being placed in a desired position.

In another embodiment, the caddy includes a foldable member that folds around the strap. Here, the inside of the member includes slots or compartments, e.g., for holding credit cards, a driver's license, etc. The outside of the foldable member includes a compartment that is sized to securely hold a cell phone. The cell phone compartment is provided in multiple sizes to hold a big or small cell phone. The outside can have other personal item holders, such as a pen/pencil holder.

The end portions of the strap couple to an assembly that includes an attachment mechanism, wherein the attachment mechanism attaches to an item of apparel worn by the user. In an embodiment, the attachment mechanism includes a spring-loaded clip, such as a "bulldog" clip or an "alligator" clip. These types of attachment mechanisms are especially convenient because a person can attach the clip by feeling for the person's pants or belt without looking down to attach the clip.

In another embodiment, the attachment mechanism includes a spring-loaded hook or alternatively a lock, hook, clip, clamp, latch, etc. The attachment mechanism rotates in an embodiment with respect to a link portion of the assembly, wherein the link portion of the assembly is moveably secured to the end portions of the strap. The link portion of the assembly can be separated from the attachment mechanism by a section, for example, a piece of the strap material.

In an embodiment a single carrier or caddy is provided and supported by the strap. In alternative embodiments, multiple carriers are slideably coupled to the strap. Further alternatively, a single carrier can have multiple slots or compartments to divide space for different personal items.

The caddies frictionally engage the strap so that the caddy is maintained at a desired position along the strap. In an embodiment, the caddy defines apertures and can include multiple layers of material that frictionally hold the caddy in place with respect to the strap. In an alternative embodiment, one or more separate locking mechanisms can be provided which aid in holding the caddy in place against the strap. The strap and caddy can be made of the same or different materials, and can be made from any material or any combination of materials, such as leather, suede, cowhide, fur, any type of polymer such as a woven polymer or extruded polymer, any type of cloth, meshed material, woven material and any combination of these.

The strap can be made in different lengths to fit different sized men and women. In an alternative embodiment, the strap is adjustable to fit different sizes of users. In the adjustable embodiment, a buckle is provided that separates the strap which is split and attached at the split ends to the buckle.

The strap and caddy are worn conveniently by persons performing virtually any activity while walking, sitting or exercising. The strap and caddy are also worn conveniently by persons driving cars, motorcycles or other types of sports vehicles. The caddy, located close to the body provides a secure location for important items such as wallets, airline tickets and passports. The present invention also aids disabled and elderly people by providing convenient access to cell phones and other items having a potential immediate need, such as medicine or emergency medical response buttons.

The strap is also adjustable and operable to be worn around the person's shoulder or be placed around the person's waist or midsection. To that end, a quick-disconnect, snap-fit type of device is provided to enable the strap to open. Afterwards, the person snaps the strap in place around the person's midsection and pulls the strap to achieve a desired fit.

It is therefore an advantage of the present invention to provide a device that enables a person to carry and access readily one or more personal items.

It is another advantage of the present invention to provide a device that houses personal items and is worn comfortably by a person.

It is a further object of the advantage of the present invention to provide a housing for a personal item that is securely attached to an item of apparel worn by the person.

It is still a further advantage of the present invention to provide a device that carries multiple items and is worn by the user.

Moreover, it is an advantage of the present invention to provide a device that allows multiple personal item carriers to be positioned at desired positions relative to user's body.

Further still, it is an advantage of the present invention to provide a personal item carrying device operable and adjustable to be worn over a person's shoulder or around the person's waist or midsection.

Additional features and advantages of the present invention are described in, and will be apparent from, the following Detailed Description of the Invention and the figures.

BRIEF DESCRIPTION OF THE FIGURES

FIG. 8 is a perspective view of one embodiment of an adjustable strap for the device of the present invention.

FIG. 9 is a perspective view of another embodiment of an adjustable strap for the device of the present invention.

DETAILED DESCRIPTION OF THE INVENTION

Figure 1:
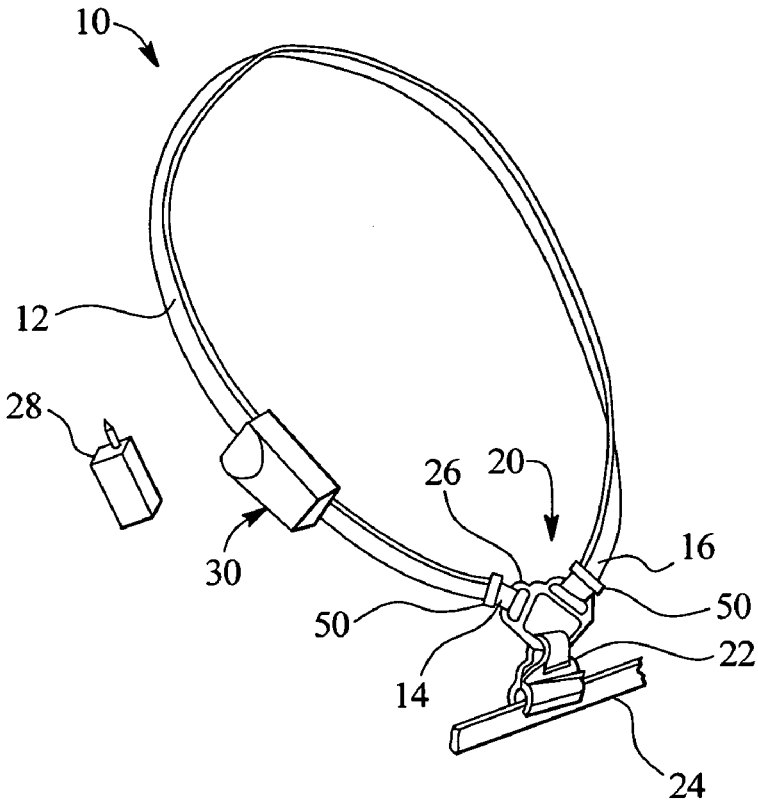
FIG. 1 is a perspective view of one embodiment of the device of the present invention showing the components of same and one embodiment for attaching the device to an item of apparel worn by the user.

Referring now to the drawings and in particular to FIG. 1, one embodiment of the device 10 of the present invention is illustrated. The device 10 is worn about the shoulder of a person and extends across the person's body, wherein device 10 links or attaches to an item of apparel worn by the person. The device includes a carrier or caddy that slidingly engages a strap, wherein the strap extends over the shoulder and attaches at its end portions, via a mechanism, to a selected item of apparel.

Device 10 includes a strap 12. Strap 12 is constructed of any desired material, such as leather, suede, cowhide, fur, cloth, a woven polymer, a non-woven polymer, a meshed material, extruded material, a cut material, and any combination of these. Strap 12 can have a number of folds or plies, such as two and/or three folds or three plies. Strap 12 can also have a smooth rib or fold of material stitched or otherwise applied to its edges to provide a smooth surface with which to move the caddy against, for example, when the strap 12 is fur or cowhide that can be damaged by an abrasive contact with the caddy.

In the illustrated embodiment, strap 12 of device 10 is sized for a particular body size or range of body sizes. The strap 12 can be made in varying lengths to fit men and women of all shapes, sizes, heights, weights, etc. FIGS. 8 and 9 below illustrate alternative straps that are adjustable. The illustrated strap 12 is shown generally as a solid structure, however, strap 12 can have any desired series of apertures or protrusions extending therefrom, providing a strong construction but allowing for design and ornamental variations.

The strap 12 includes end portions 14 and 16. In the illustrated embodiment, end portions 14 and 16 of strap 12 define a loop or ring for attachment to a link portion 26 of assembly 20. The loop or ring of the end portions 14 and 16 is formed in an embodiment by stitching the end portions 14 and 16 so as to form the loop. In an alternative embodiment, the loop is formed by heat sealing, an adhesive seal, via compression bands 50 (as illustrated) that hold two pieces of the strap 12 together in a looped fashion or any combination thereof. In an embodiment, band 50 is of the same material as strap 12, however, band 50 can be of a different material than strap 12. Band 50 can for example be hard plastic or metal, wherein the strap 12 is of a flexible material.

End portions 14 and 16 loop around the link portion 26 of the assembly 20, so that the strap 12 is fixed to the assembly 20. In the illustrated embodiment, the loops formed at end portions 14 and 16 allow the strap 12 to move or rotate with respect to the assembly 20. This feature enables the assembly 20 to move as necessary relative to the end portions 14 and 16 of the strap 12. In the illustrated embodiment, end portions 14 and 16 are permanently and rotatably fixed to the assembly 20. In an alternative embodiment, end portions 14 and 16 are configured such that the strap 12 is removable from the assembly 20, for example, to replace a worn or damaged strap 12 or so that different colors and styles of the strap 12 and assembly 20 can be mixed and matched.

The assembly 20 includes an attachment mechanism 22. The attachment mechanism 22 in an embodiment is integral to the assembly 20. In another embodiment, attachment mechanism 22 fixedly attaches or adheres to the link portion 26 of the number 20. In the embodiment illustrated in FIG. 1, attachment mechanism 22 rotatably or hingedly attaches to the link portion 26 of the assembly 20. The degree of freedom provided by the rotational attachment of the mechanism 22 to the assembly 20 further provides for a flexible attachment of the device 10 to the item of apparel 24, so that strap 12 fits comfortably about the user's body.

Attachment mechanism 22 in the illustrated embodiment includes a spring-loaded clip that biases the mechanism to be fixed to the item of apparel 24. The spring-loaded clip can be of any desired form, size and variety. In one preferred embodiment, the spring-loaded clip as illustrated has the shape of a "bulldog" clip as this term is known in the art. The bulldog clip is advantageous because it allows the device 10 to be attached either to a belt, the top of a pair of pants, a skirt, a dress, a shirt, a sweater, a jacket or any other item of apparel, collectively referred to herein as apparel item 24. Another type of spring clip useable with the present invention is an "alligator" clip.

The link portion 26 and the attachment mechanism 22 of the assembly 20 are made of the same material in an embodiment, however, the link 26 and mechanism 22 can be made of different materials in alternative embodiments. In various embodiments, the link 26 and the attachment mechanism 22 are made of metal, hard plastic, wood, stone and any combination of these. They can have adornments and design features tailored to men's or women's fashions The link 26 defines one or more apertures for receiving the end portions 14 and 16 of the strap 12 and for receiving the attachment mechanism 22. While FIG. 1 illustrates one possible configuration for the link portion 26 of the assembly 20, it is possible for those skilled in the art to develop various different configurations for the link portion 26, which can include one or more apertures. Alternatively, the link portion 26 includes protrusions (not illustrated) that extend through and attach to the end portions 14 and 16 of the strap 12 and/or the attachment mechanism 22.

The device 10 enables the user to conveniently insert and remove a personal item 28 into and from, respectively, a carrier or caddy 30. Item 28 as illustrated is a cell phone in one embodiment. The personal item 28 can be any transportable item including any one or more of the following: a pager, a wallet, a passport, an airline ticket, medicine, a portable compact disc player, a compact disc, a cigarette package, makeup, an address book, digital music players (MP3, miniature disk and the like), hand-held email and/or internet access devices, combinations of such devices with cell phones and various other items that are of a size and weight that allow for comfortable transportation via the strap 12 and carrier 30. The caddy 30, which is illustrated in more detail below, is made of the same material as the strap 12 in an embodiment, however, the caddy 30 can be made of a different material than the strap 12 in various alternative embodiments. The material for the carrier or caddy 30 includes any of the materials listed above for strap 12.

In an embodiment, one of the end portions 14 or 16 is removable from the link 26 of the assembly 20, so that the caddy 30 can slide off of the removable end portion. This enables damaged or worn carriers or caddies to be replaced and also enables different straps 12 and caddies 30 to be mixed and matched. In an alternative embodiment, the caddy 30 provides a hinged or removable portion that allows the caddy to be removed directly from the strap 12.

Figure 2:
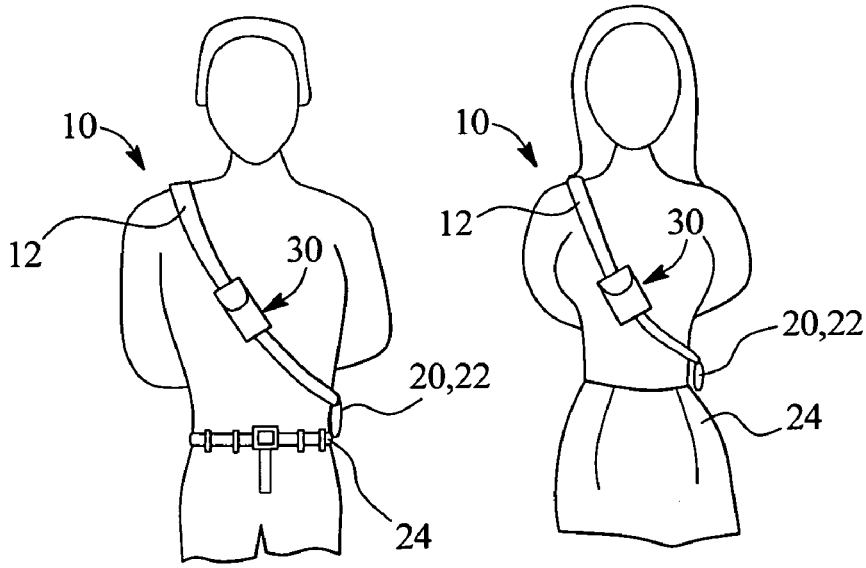
FIG. 2 is a schematic view of a man and a woman wearing the device having the slideable caddy of the present invention.

Referring now to FIG. 2, the device 10 is illustrated positioned onto male and female users. The strap 12 is sized so that the strap extends up across the front of the user's body, over a shoulder on one side of the users body, and down across the back of the user's body towards the opposite side of the body from the shoulder that receives strap 12 and to the same side of the body from which the strap originated. The end portions 14 and 16 of strap 12 reside at or near the waist or midsection of the user, wherein the assembly 20 having the attachment mechanism 22 attaches and secures strap 12 of the device 10 to an item of apparel 24. As illustrated, men typically wear belts, so that the assembly 20 and attachment mechanism 22 attach the strap 12 to the belt. However, even when wearing a belt, or in the case of women who many times do not wear belts, e.g., when wearing a skirt, the attachment mechanism 22 of the assembly 20 can alternatively attach to the pants, skirt, dress or any of the other apparel items 24 listed above.

Figure 3:
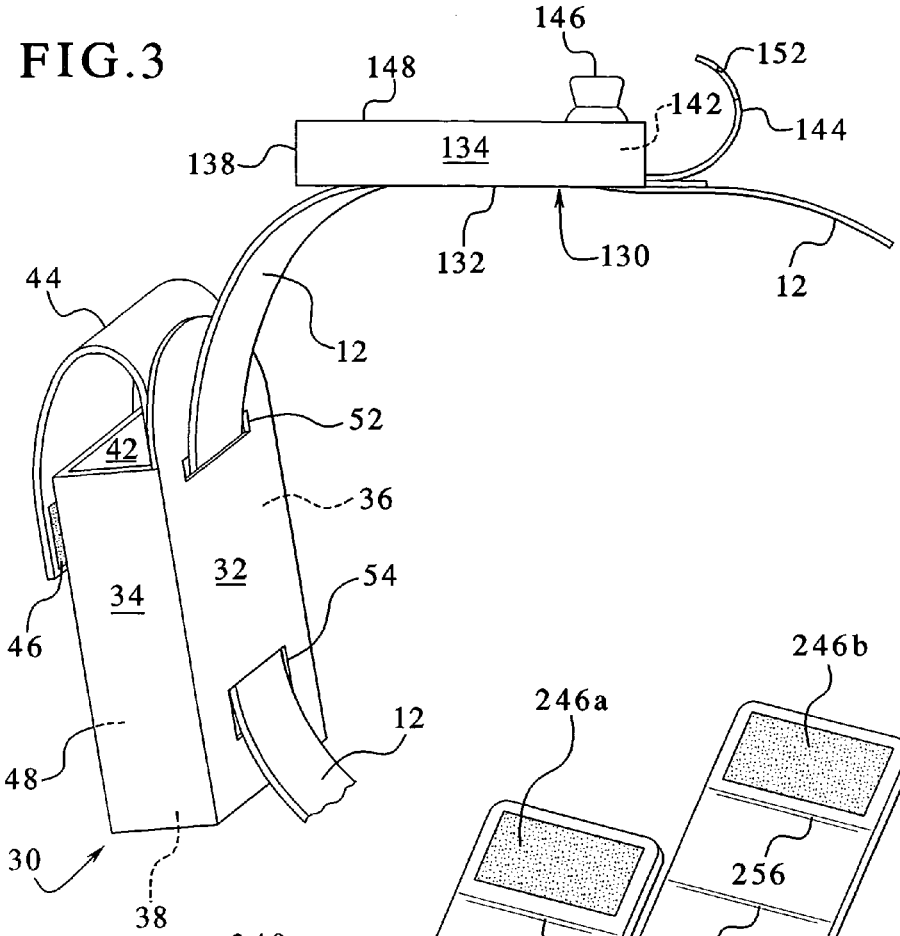
FIG. 3 is a perspective view of first and second caddies that each slideably engage a single strap.

Referring now to FIG. 3, one embodiment for the arrangement of strap 12 with caddy 30 and an additional second carrier or caddy 130 is illustrated. FIGS. 1 and 2 illustrated that strap 12 in an embodiment supports a single carrier or caddy 30. FIG. 3 illustrates that strap 12 can support multiple caddies, such as caddy 30 and second caddy 130. Although FIG. 3 illustrates two separate caddies supported by strap 12, any suitable number of caddies that can fit onto the strap (on either the front or back of the person) is possible.

One embodiment for attaching the caddy 30 to the strap 12 is illustrated in FIG. 3. Caddy 30 includes a back 32, sides 34 and 36 and a bottom 38. The caddy is generally a five-sided structure that defines an opening 42 for receiving one or more personal items 28. For example, opening 42 in FIG. 3 could be sized to hold a single cellular phone, or alternatively, be sized to hold a cell phone and an item of makeup or a credit or debit card. To facilitate the holding of multiple items, inner pockets or compartments are provided in an embodiment. In an alternative embodiment, outer pockets or compartments are provided, for example, on the front 48 of the caddy 30.

The back 32 is formed in an embodiment from a separate piece of material that also forms a cover or flap 44 that folds over the top of the opening 42, securing personal items 28 that are inserted into caddy 30. An attachment mechanism 46, such as Velcro® strips or the like is provided between an end portion of the cover or flap 44 and the upper portion of the front 48 of caddy 30.

As seen in FIGS. 1 and 2, the strap 12 provides an area along the front side of the body of the user with which the user can adjust the caddy 30 up towards the shoulder on the first side of the body or down towards the waist or midsection of the second side of the body. The present invention provides a mechanism that allows the user to slide easily the caddy 30 up or down, wherein the caddy 30 is held in place at the position desired by the user. FIG. 3 illustrates one possible mechanism for providing such a feature. In FIG. 3, back 32 defines apertures 52 and 54 that allow strap 12 to extend into one of the apertures and out of the other aperture, wherein a portion of the strap is maintained inside of the back 32 of the caddy 30. In the illustrated embodiment, the apertures 52 and 54 are sized and the back 32 and the piece forming the cover or flap 44 are fabricated sufficiently tightly against one another so that the caddy 30 does not move relative to the strap 12 without a relatively strong force applied to the caddy 30 to move same. For example, it is contemplated that the force of gravity or forces created inadvertently by walking, jogging or running with the carrier or caddy in place would not be sufficiently strong enough to move or let slip caddy 30 along strap 12.

In an alternative embodiment, one or more mechanisms not illustrated can be provided to hold the caddy 30 on the strap 12 in a desired position. For example, a number of protrusions can extend from the back 32 and the strap 12 could define a number of apertures, wherein the protrusions and apertures are spaced apart the same distance and wherein the user can force the protrusions to extend into the apertures when the device 30 is in a desired position. In a further alternative embodiment, a separate locking mechanism is provided on the strap 12, wherein the user slides the additional locking mechanism up against the caddy 30 when the caddy 30 is at a desired position. The additional locking mechanism, for example, can be a plastic piece that frictionally couples to the strap 12 and requires a fairly significant amount of force to move relative to the strap 12. In an embodiment, the additional locking mechanism is provided on strap 12 on one or both sides of the caddy 30.

The second carrier or caddy 130 includes many of the same components as caddy 30, such as a back 132, sides (e.g., side 134), a bottom 138, a front 148, a cover or flap 144 and an attachment mechanism 146. The second caddy 130 is five-sided and defines an opening 142 that receives an item 28. In an embodiment, opening 142 is sized differently from opening 42 of caddy 30, wherein the first and second caddies 30 and 130 are sized to receive differently sized items 28. Each of the alternative embodiments, such as the internal and external pockets or compartments described above in connection with the caddy 30, is also applicable to the second caddy 130. The second caddy 130 includes a different attachment mechanism 146 than that shown with caddy 30. Caddy 30 uses a Velcro® type attachment mechanism, wherein attachment mechanism 146 includes a tab that rotates relative to a base portion, wherein the cover or flap 144 defines an aperture 152 that slides over the tab when the tab is aligned with the aperture 152 and wherein the tab can turn, for example ninety degrees, and hold the cover or flap in place.

The second caddy 130 includes each of the alternative embodiments described above for slidingly and frictionally engaging the caddy 130 to the strap 12. The second caddy 130 is positioned a desired distance away from the first caddy 30. Although only two caddies are illustrated in FIG. 3, any number of suitably sized caddies or carriers can be provided.

Figure 4:
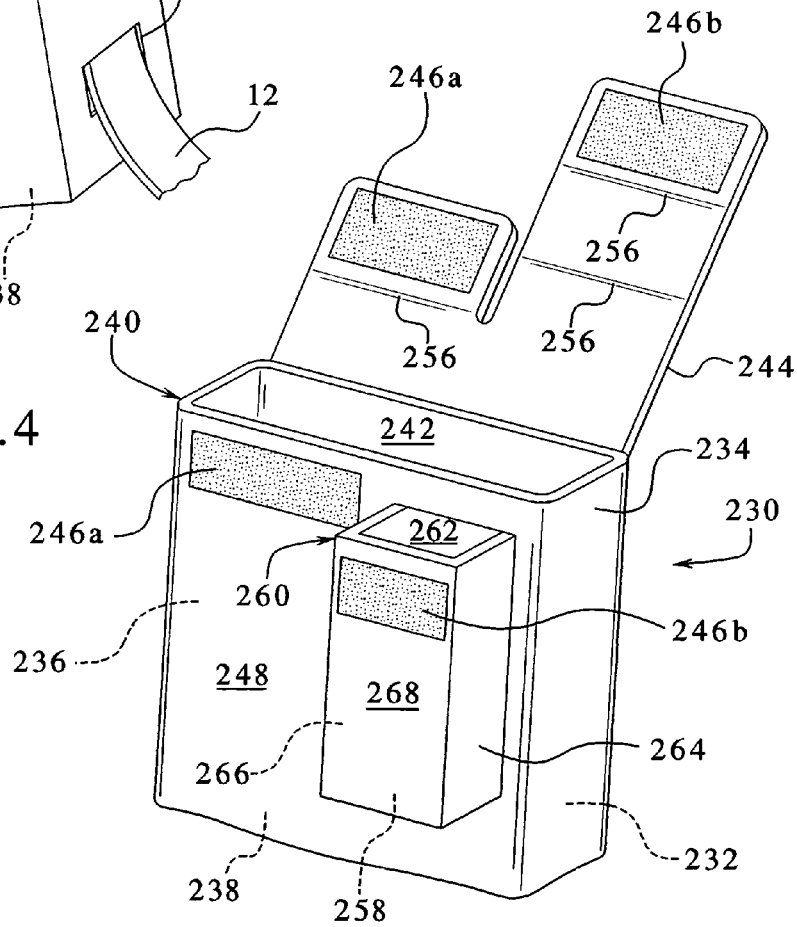
FIG. 4 illustrates an alternative caddy that includes multiple compartments for holding differently sized personal items.

Referring now to FIG. 4, a multi-carrier 230 is illustrated, which includes multiple carriers 240 and 260 defining apertures 242 and 262, respectively, which are sized to receive multiple components, such as a portable compact disc player and a cell phone. The multi-carrier 230 includes a back 232, sides 234 and 236, a bottom 238 and a front 248. These structures define a relatively large opening 242 for receiving a single larger personal item or multiple smaller personal items. Again, opening 242 can be separated by one or more compartments, pockets or divisions.

Opening 242 is defined by the first carrier 240. Opening 262 is defined by a second carrier 260 of the multi-carrier 230. The second carrier 260 as illustrated is sized differently than the first carrier 240. The second carrier 260, however, includes similar components, such as sides 264 and 266, a bottom 258 and a front face 268. The back side of carrier 260 is formed by the front 248 of the carrier 240. Although multiple carrier 230 is illustrated as having two carriers, it should be appreciated that any number of suitably sized carriers may be provided in multiple form.

A cover or a flap 244 extends over the openings 242 and 246 and any personal item 28 inserted into the openings. The cover 244 includes a number of fold lines 256 that allow the cover 244 to fit snuggly over and protect the personal item 28. Cover 244 also includes multiple attachment mechanisms **246*a* and 246*b* that attach to mating mechanisms 246*a* and 246*b* on the respective fronts 248 and 268 of the larger and smaller carriers 240 and 260, respectively of the multiple carrier 230. Carriers 240 and 260 of multi-carrier 230 can have the same or different types of attachment mechanisms 146*a* and 146*b*, which include any of the types disclosed previously. The flap 244 is sized differently at different portions to reach the mating attachment mechanisms on the fronts 248 and 268**.

Figure 5:
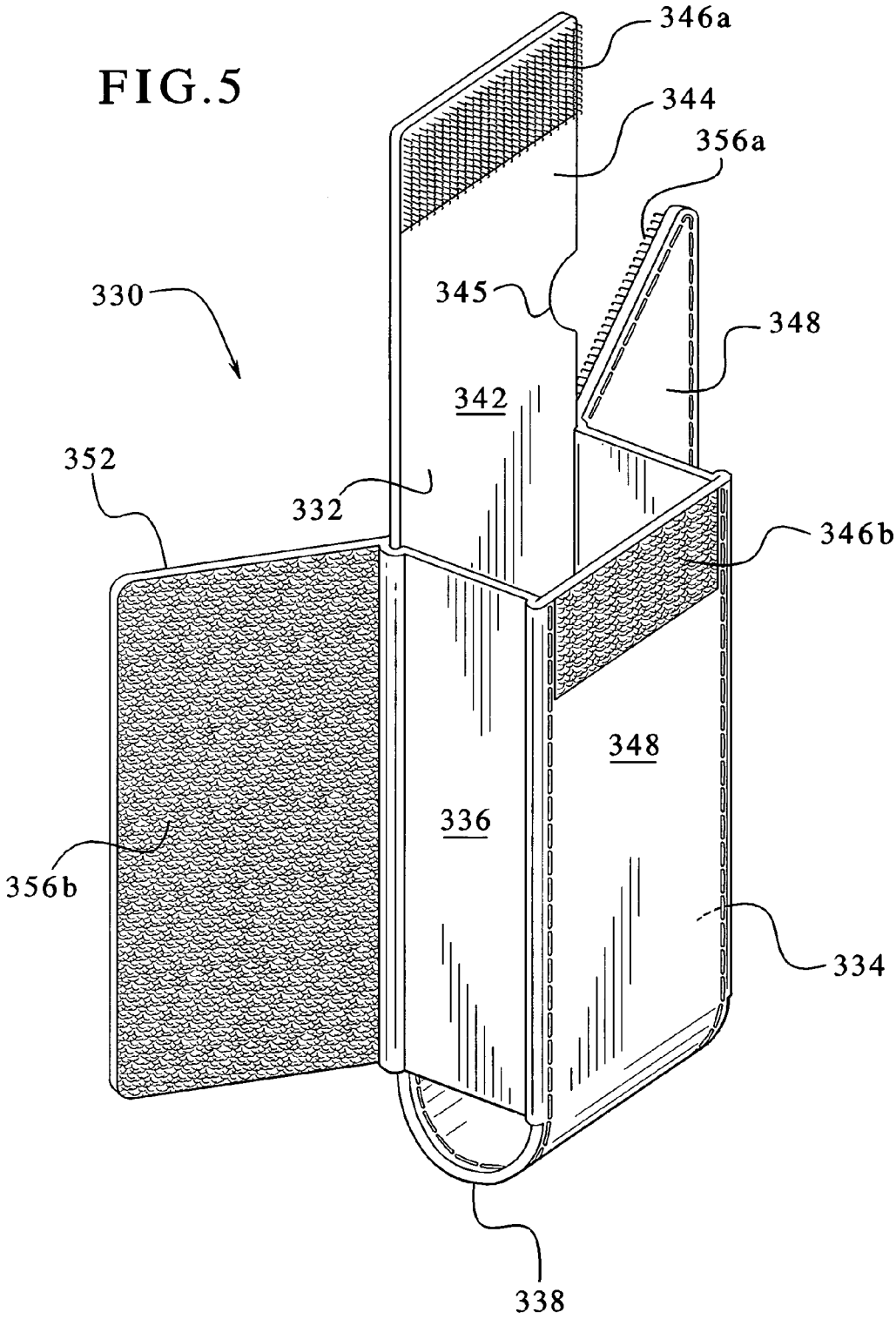
FIG. 5 is a perspective view of one embodiment for the caddy of the present invention.

Referring now to FIG. 5, one preferred embodiment for a caddy of the present invention is illustrated by caddy 330. Caddy 330 includes a back 332, sides 334 and 336 and a looped bottom 338. Caddy 330 is generally a five-sided structure that defines an opening 342 for receiving one or more personal items 28. As described above, opening 342 could be sized to hold a single cellular phone, or alternatively, be sized to hold a cell phone and an item of makeup or a credit or debit card or any of the other items described above. To facilitate the holding of multiple items, inner pockets or compartments are provided in an embodiment. In an alternative embodiment, outer pockets or compartments are provided, for example, on the front 348 of the caddy 330.

The back 332 extends upward to form a cover or flap 344 that folds over the top of the opening 342, securing personal items 28 that are inserted into caddy 330. An attachment mechanism **346*a*, 346*b*, such as Velcro® strips or the like is provided between an end portion of the cover or flap 344 (346*a*) and the upper portion of the front 348 (346*b*) of caddy 330. The flap 344** in an embodiment defines a cutout 345 that enables a telephone antenna to project through the cutout. Caddy 330 uses the alternative attachment mechanism 146/152 described above.

As discussed above, the strap 12 provides an area along the front side of the body of the user with which the user can adjust the caddy 330 up towards the shoulder on the first side of the body or down towards the waist or midsection of the second side of the body. Caddy 330 provides folds 348 and 352 that fold together, clasping around the strap 12 and allowing the user to slide easily the caddy 30 up or down, wherein the caddy 30 is held in place at the position desired by the user. The strap 12 is inserted between the back 332 and the fold 352. Fold 352 has a locking mechanism 356*b* on its outer surface, such as a Velcro® strip. Fold 348 has a locking mechanism 356*a* on its inner surface, such as a matching Velcro® strip. In an alternative embodiment, the outer surface of the back 332 can include one or more Velcro® strip and a smooth strip, wherein only a single flap is used, the single strip having a matching one or more Velcro® strip on its inner surface and wherein the smooth strip slides along the strap 12.

The flaps 348 and 352 are fabricated so as to provide a locking mechanism sufficient so that the caddy 330 does not move relative to the strap 12 without a relatively strong force applied to the caddy 330 to move same. It is again contemplated that the force of gravity or forces created inadvertently by walking, jogging or running with the carrier or caddy in place would not be sufficiently strong enough to move or let slip caddy 330 along strap 12. Any of the alternative devices discussed above for holding the caddy relative to the strap are contemplated for caddy 330. For example, a separate locking mechanism can be provided on the strap 12, wherein the user slides the additional locking mechanism up against the caddy 330 when the caddy 330 is at a desired position.

Each of the alternative embodiments, such as the internal and external pockets or compartments described above in connection with the caddy 30, is also applicable to the second caddy 330. Caddy 330 can be constructed from any of the materials and combinations therefore discussed above. Certain of the components of caddy 330, such as any one or more of the folds 348, 352, sides 334, 336, front 348, back 332 and flap 344 can have multiple plies, such as two or three plies that are sown, stitched or otherwise adhered together.

Figure 6:
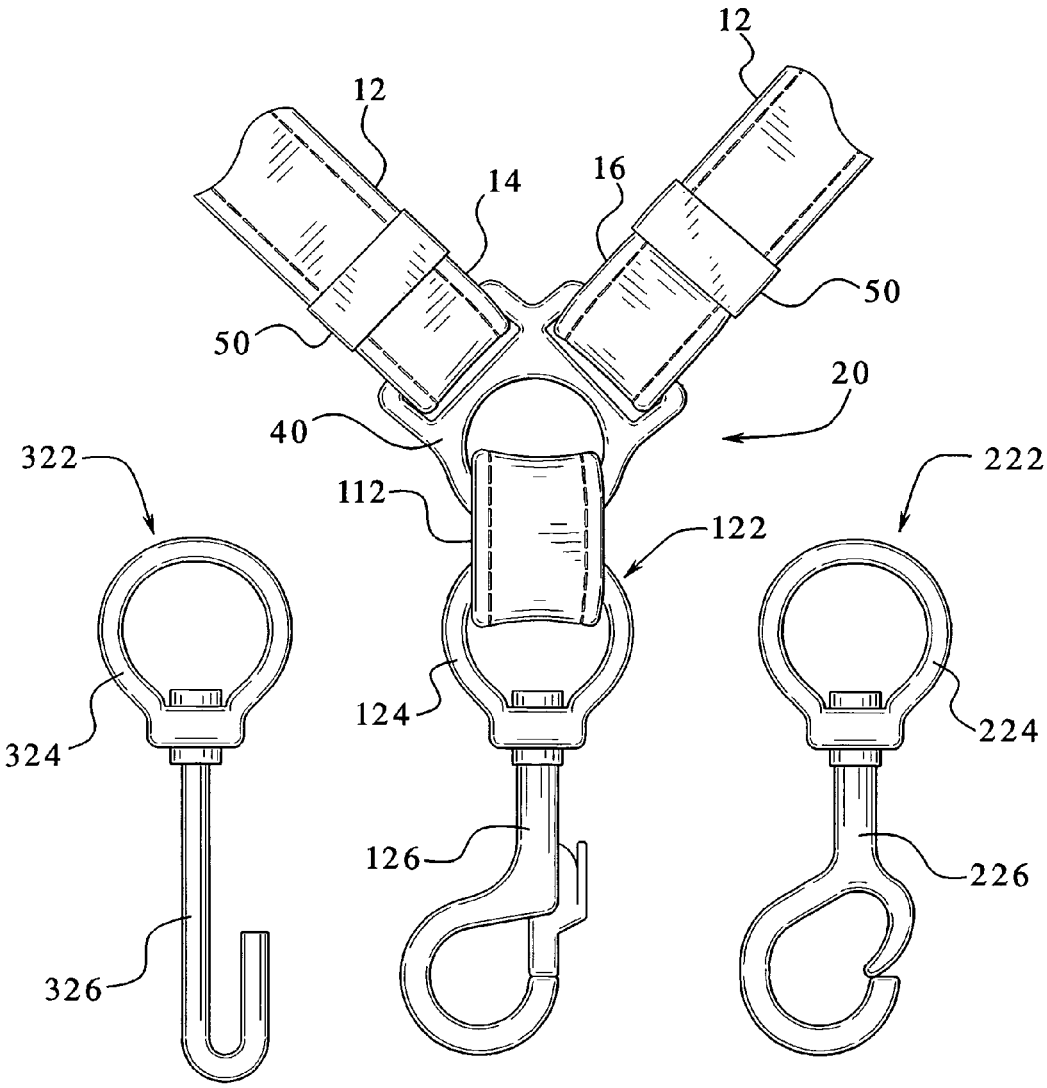
FIG. 6 is an elevation view of the end portions of the strap connected to various alternative attachment mechanisms of the present invention.

Referring now to FIG. 6, various alternative embodiments for the assembly 20 and attachment mechanism 22 shown in FIG. 1 are illustrated. As described above in connection with FIG. 1, the strap 12 includes end portions 14 and 16. In an embodiment, the end portions 14 and 16 form loops, which in the illustrated embodiment are secured via bands 50. The assembly 20 in FIG. 1 includes a link portion 26 connecting ends 14 and 16 and an attachment mechanism 22 connected directly to the link portion 26. The configuration illustrated in FIG. 6 is slightly different. Here, end portions 14 and 16 couple to a ring portion 40 of the assembly 20, wherein an intermediate section 112 couples the ring portion 40 to one of a various number of the attachment mechanisms, illustrated here as alternative attachment mechanism 122.

In an embodiment, ring portion 40 is or resembles a metal or plastic halter square used typically to fasten horse harnesses. The end portions 14 and 16 couple to the ring portion 40 via any of the embodiments described above for coupling the end portions 14 and 16 to the link 26 of assembly 20 in FIG. 1. Section 112 is of the same material as the strap 12 in an embodiment, however, section 112 can be made of any desired material described above for the strap 12 and can be of the same or different material as strap 12.

As illustrated, the ring portion 40 attaches moveably or rotatably to the end portions 14 and 16, creating the desirable overall flexible assembly 20 in a similar manner as the flexible assembly 20 illustrated in FIG. 1. The section 112, which in an embodiment forms a loop about the ring portion 40 of the attachment mechanism 122, also provides for a flexible attachment between assembly 20, an item of apparel and the strap 12 when it is placed about the user's body. The section 112 can have various different lengths, which allow the end portions 14 and 16 to reside higher or lower with respect to the person's waist or midsection and also allows for varying angles of the strap 12 across the front and back of the user's body.

FIG. 6 also illustrates multiple embodiments for alternative attachment mechanisms, which can be any type of clip, hook or lock. FIG. 6 illustrates three different attachment mechanisms 122, 222 and 322. Attachment mechanism 122 includes a ring portion 124 and a spring-loaded hook 126. Spring-loaded hook 126 connects rotatably to the ring portion 124. Spring-loaded hook 126 is designed to hook around a belt or other item that can be encircled.

Alternative attachment mechanism 222 also includes a ring portion 224 and a hook 226. Hook 226 does not include a separate spring but instead uses the flexibility of the hook ends to create a biased connection between the ends. The user can push or move one of the ends to allow the hook to open up for fastening to an item of apparel worn by the user. Hook 226 as before attaches rotatably to the ring portion 224 of alternative attachment mechanism 222.

Attachment mechanism 322 shows a further alternative embodiment. Attachment mechanism 322 includes a ring portion 324 and a hook portion 326 that is rotatably coupled to the ring 324. Hook portion 326 slides around the user's belt or other item of apparel 24 suitably grasped by hook 326.

Figure 7:
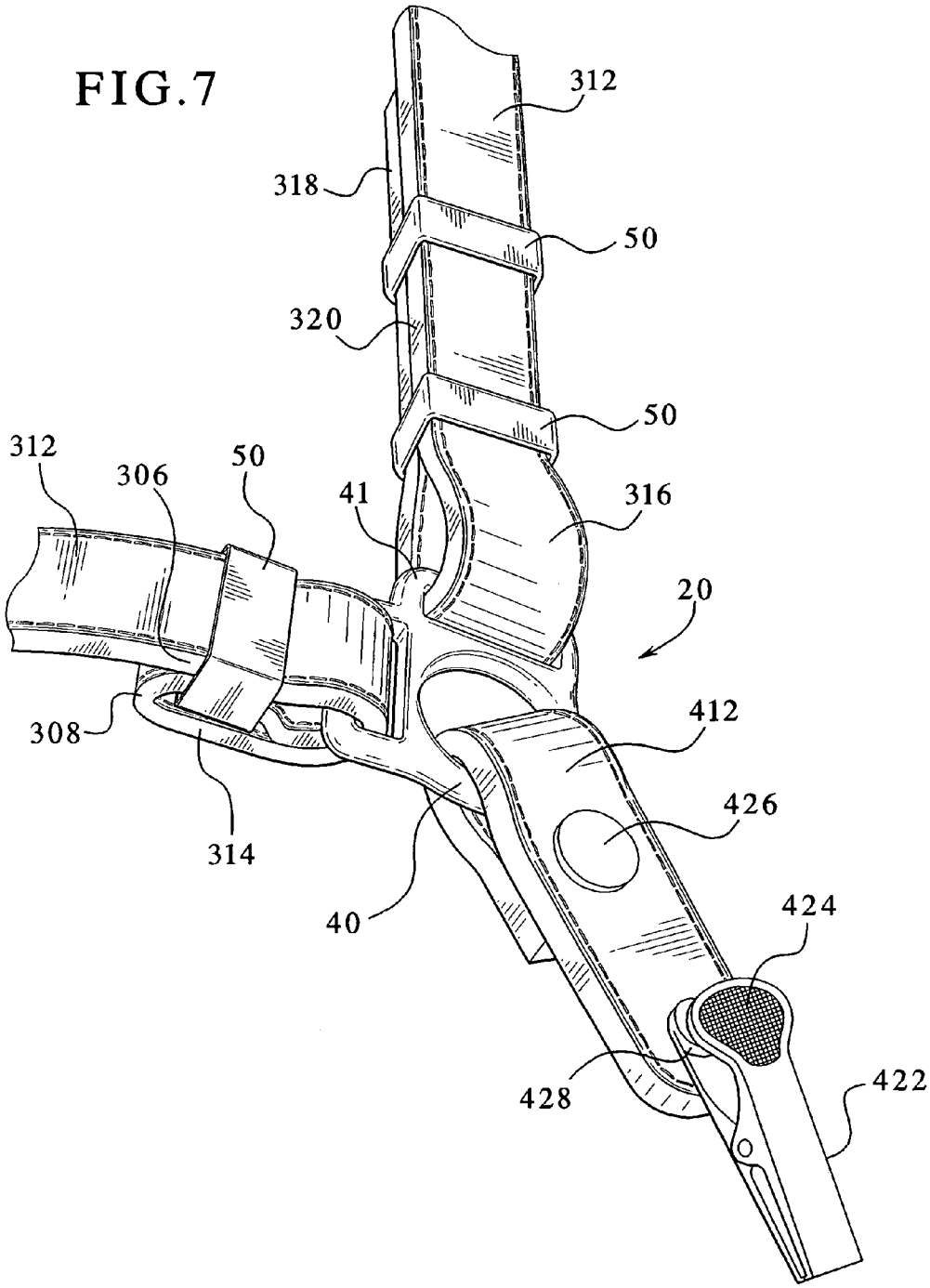
FIG. 7 is a perspective view of one embodiment for providing detachable end portions of the strap connected to one preferred attachment mechanism.

Referring now to FIG. 7, one preferred arrangement for the assembly 20 having an attachment mechanism 422 is illustrated. Here, a strap 312 includes detachable end portions 314 and 316. The strap 312 and end portions 314 and 316 can be made of any of the materials described above and can have multiple plies or folds that can be stitched or otherwise attached to one another. In an embodiment, the end portions 314 and 316 form loops, which in the illustrated embodiment are secured via bands 50. The assembly 20 includes the ring portion 40 described above in connection with FIG. 6. Ring portion 40 is or resembles a metal or plastic halter square in one embodiment. Strap 312 can be of any of the materials described above and have multiple plies, for example, strap 312 can be of three plies in the portion receiving the caddy and two plied where connected to the halter square.

The band 50 at the end portion 316 of strap 312 frictionally but moveably and slideably engages the strap 312. The inner sides of sections 318 and 320 of end portion 316 include mating attachment mechanisms, such as mating Velcro® strips (the strips are provided in a thin form, Velcro USA 805 (Hook) and 3610 (Loop), which may be used for sections 318 and 320), which hold sections 318 and 320 together in the illustrated looped fashion about a rung portion 41 of the ring portion 40 of assembly 20. A person can slide bands 50 away from assembly 20, pull sections 318 and 320 apart and remove end portion 316 from ring portion 40. In a similar manner, band 50 at the end portion 314 of strap 312 allows for enough play so that attachment mechanisms, such as mating Velcro® strips, which hold opposing surfaces of sections 306 and 308 together can be pulled apart and reattached. Strap 312 can therefore be removed completely from ring portion 40 of assembly 20 to swap out components for fashion purposes or to replace worn or broken components.

As with the embodiment illustrated in FIG. 6, a section 412 in FIG. 7 couples the ring portion 40 to any of the various attachment mechanisms described above. Section 412 is of the same material as the strap 312 in an embodiment, however, section 412 can be made of any desired material described above for the strap 12 and can be of the same or different material as strap 312. Section 412 can have multiple plies or folds that can be stitched or otherwise attached to one another.

As illustrated, the ring portion 40 attaches moveably or rotatably to the end portions 314 and 316, creating the desirable overall flexible assembly. Section 412, which in an embodiment forms a loop about the ring portion 40 of the attachment mechanism 122, also provides for a flexible attachment between assembly 20, an item of apparel and the strap 12 when it is placed about the user's body. Section 412 can have various different lengths, which allow the end portions 314 and 316 to reside higher or lower with respect to the person's waist or midsection and also allow for varying angles of the strap 312 across the front and back of the user's body.

Section 412 forms a loop about ring portion 40. In the illustrated embodiment, ring portion 40 includes a snap 426 that allows the section 412 to attach removeably to ring portion 40. Section 412 can therefore be removed completely from ring portion 40 of assembly 20 to swap out section 412 for fashion purposes or to replace section 412 or ring portion 40 if either becomes worn or broken. In an alternative embodiment, Velcro® strips and/or a band 50 shown above holding end portions 314 and 316 together are used instead of snap 426. Conversely, snap 426 can be used in place of the Velcro® strips and band 50 for one or both of the end portions 314 and 316 of strap 312.

FIG. 7 shows one preferred attachment mechanism 422, which is a bulldog type clip. Bulldog clip 422 is attached to section 412 in an embodiment via a rivet 428, wherein clip 422 can rotate with respect to section 412 about the rivet connection. Bulldog clip 422 includes or defines a grasping area 424, which is widened to allow a person to more easily grasp or apply force to attachment mechanism 422 when attaching or removing attachment mechanism 422 to or from an item of apparel. Grasping area 424 can have indentations, be knurled or provide a padded surface to further aid the person in attaching or removing attachment mechanism 422.

Referring now to FIG. 8, one embodiment of an adjustable strap 212 is illustrated. Strap 212 is shown with arrows pointing towards a first end portion 214 and a second end portion 216. Upper portion 228 of the strap leads to end portion 214 defines a loop 218, which can be produced by a stitching, adhering, heat sealing or mechanically attaching a folded portion of the strap 212 together. A lower portion 208 leads to end portion 216. In an alternative embodiment, the loop 218 can be provided on the lower portion 208 leading towards end portion 216, wherein the adjustable strap 212 operates in a reverse manner from the ones shown here.

In operation, portion 208 folds through a buckle 220 and can include a folded catch 206 at its end so that portion 208 does not come loose completely from buckle 220. Buckle 220 also includes an inner rung (not seen) around which loop 218 of portion 228 extends and secures. Buckle 220 also includes a rung 204 around which portion 208 extends. Portion 208 folds over rung 204 and then beneath an outer rim 202 of Buckle 220. Buckle 220 enables the person to pull on the folded catch 206 of portion 208 to shorten the overall length of the strap 212 or pull on the body of portion 208 to loosen and thereby lengthen the overall length of strap 212.

Referring now to FIG. 9, another embodiment of an adjustable strap 512 is illustrated. Strap 512 can be of any of the materials described above and have multiple plies that are stitched or otherwise attached to one another. Strap 512 is shown with arrows pointing towards a first end portion 514 and a second end portion 516 of strap 512. Portion 518 of the strap leads to end portion 514 and defines a number of apertures 522. Another portion 520 leads to end portion 516. Portion 520 is stitched together in a number of places so as to loop around a rung 524 of a buckle 526 and hold band 50 in place. Buckle 526 also includes a hinged projection 528 that is inserted through one of the apertures 522 selected so that strap 512 forms a loop having a desired size.

In operation, the adjustment of strap 512 is substantially that of adjusting a belt and belt buckle. Band 50 performs the function of a pant loop, holding the loose portion 518 close to the portion 520. In an alternative embodiment, band 50 is slideably adjustable to hold the loose portion 518 close to the portion 520. In a further alternative embodiment band 50 operates with Velcro® strips placed on opposing surfaces of portions 518 and 520 as discussed above with FIG. 7. Still further, a snap such as illustrated above with FIG. 7 is used to adjust the loop size of the strap.

Figure 10:
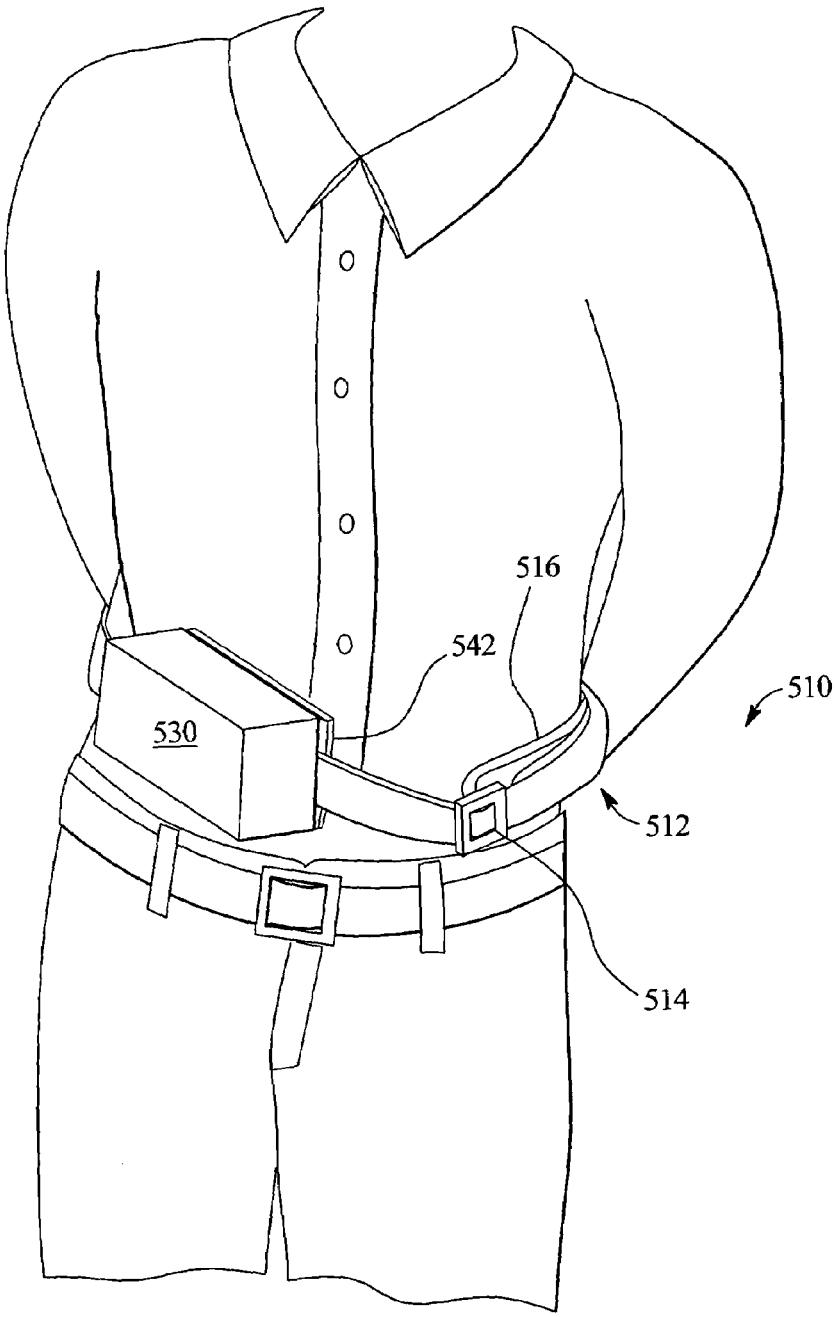
FIG. 10 is a schematic view of a person wearing one embodiment of the present invention around the person's midsection or waist.
Figure 11:
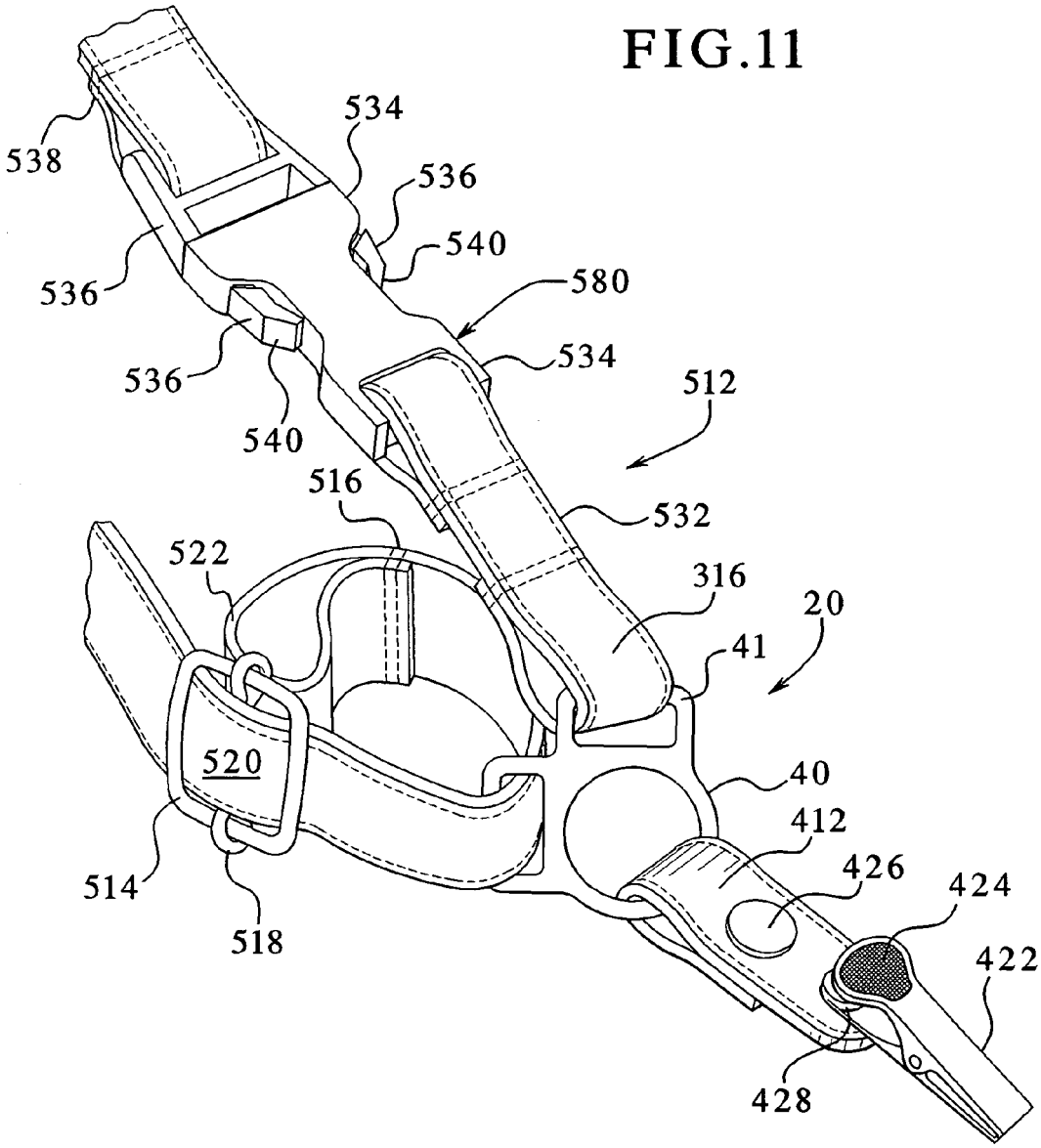
FIG. 11 is a perspective view of one embodiment for the strap of the present invention.
Figure 12:
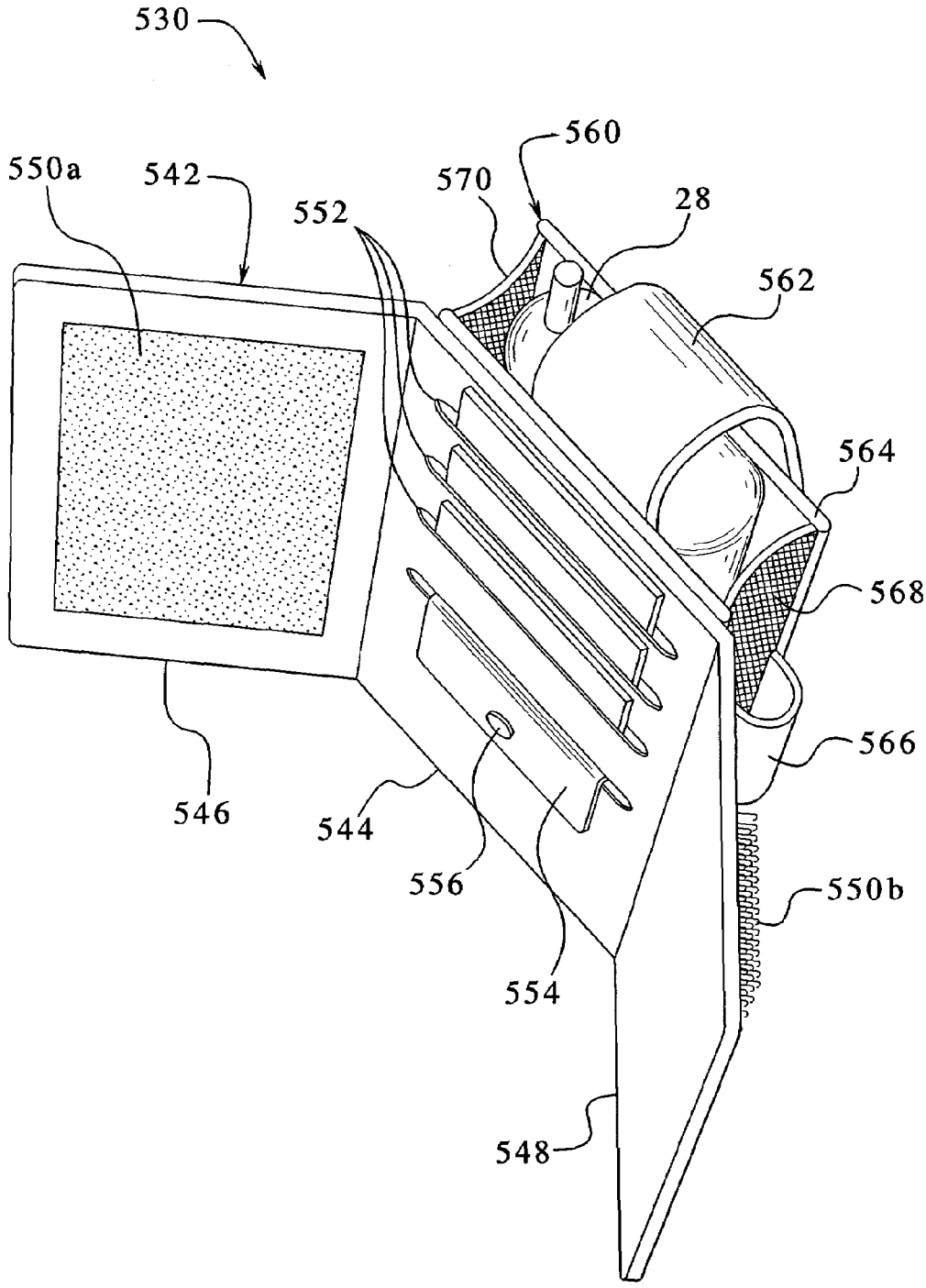
FIG. 12 is a perspective view of one embodiment for the carrier of the present invention.

Referring now to FIGS. 10 to 12, one preferred embodiment of the present invention is illustrated by assembly 510. Assembly 510 includes an adjustable strap 512 shown in both FIGS. 10 and 11 and a multi-compartment personal item carrier 530 shown in FIGS. 10 and 12. It should be appreciated that carrier 530 can be used with any of the previous straps described herein. Likewise, strap 512 can be used with any of the carriers described previously.

FIG. 10 illustrates a person wearing strap 512 in an alternative arrangement substantially around the person's waist or midsection. The strap 512 is adjustable via an adjustment hoop 514 and a strap loop 516. FIG. 11 illustrates hoop 514 and loop 516 in more detail. As seen in FIG. 11, hoop 514 cooperates with an eyelet 518 to slidingly engage a portion 520 of strap 512 and fixedly engage an end 522 of loop 516. As hoop 514 and eyelet 518 are slid back and forth along section 520 of strap 512, the overall diameter of, or area circumscribed by, strap 512 becomes smaller or bigger, depending on which direction the components 514 and 518 are slid. In particular, if hoop 514 and eyelet 518 are slid towards ring portion 40, the overall diameter of, or area circumscribed by, strap 512 increases. Likewise, when the apparatuses 514 and 518 are slid away from ring portion 40, the overall diameter of, or area circumscribed by, strap 512 decreases. Such adjustments enable the person to either wear assembly 510 around the shoulder as shown above in FIG. 2, or be worn around the person's waist or midsection as shown in FIG. 10.

When placed around the person's waist or midsection, strap 512 resides relatively horizontally around the person's midsection. The carrier 530 can likewise be slid lengthwise along strap 12.

FIG. 11 also illustrates that a quick-disconnect device 580 is placed between the ends of strap 512, wherein those ends are attached to ring portion 40. In the illustrated embodiment, quick-disconnect 580 is coupled to one end of a strap segment 532. The other end of segment 532 is couple to rung 41 of the ring portion 40. Segment 532 can be of any suitable length. Section 532 is coupled to portion 534 of quick-disconnect 580. Portion 536 of quick-disconnect 580 is in turn coupled to a strap section 538 of strap 512. Strap section 538 wraps around and meets strap section 520, completing the openable looped strap 512 of the present invention.

When the person presses fingers 540 of portion 536 of quick-disconnect 580, portions 534 and 536 come readily apart from one another. The person then places strap 512 around the person's waist or midsection similar to the manner in which the person would place a belt around the person's waist or midsection. The person then reconnects disconnect 580 by translating portions 534 and 536 together. Fingers 540 eventually move to snap-fit into portion 534. The person can thereafter adjust the length of strap 512 via the method described previously.

FIG. 12 illustrates a perspective view of one preferred embodiment for the carrier or caddy of the present invention. Carrier 530 includes a foldable member 542. Foldable member 542, which can also be seen in FIG. 10, includes a center section 544 and outer folding sections 546 and 548. To install carrier or caddy 530 about a strap, such as strap 512, the person places the inside of inner section 544 against one side of the strap and folds flap 548 over the opposing side of the strap. An attachment mechanism 550 enables flaps 546 and 548 to be attached removably to one another. In the illustrated embodiment, attachment mechanism 550 (including components 550*a* and 550*b*) is a frictionally engaging or Velcro® type of mechanism.

The softer portion 550*b* of the frictional, Velcro® type attachment 550 appears on the outside of flap 548. The more rigid or prickly portion 550*a* of the frictional or Velcro® attachment mechanism 550 is placed on the inner side of flap 546 of folding member 542. To complete the attachment of caddy 530 to strap 512, the person folds flap 546 over flap 548, thereby coupling attachment portion 550*a* to attachment portion 550*b*. It should be appreciated that other types of attachment mechanisms can be used with flaps 546 and 548 of folding member 542, such as a buckle, a snap-fitting apparatus, a button, a magnetic device, a clip, an alternative frictionally securing device and any combination thereof.

While member 542 is illustrated having two flaps 546 and 548, member 542 in an alternative embodiment includes only a single flap. That single flap attaches and disconnects from center section 544 via any of the attachment mechanisms described herein.

The inner side of folding member 542 defines a plurality of slots 552 and compartments 554 for holding various different types of personal items. Carrier 530 is adaptable to hold any of the personal items listed herein. Moreover, while three slots 552 and a single compartment 554 are illustrated in FIG. 12, it is also possible to have alternative arrangements, such as multiple compartments 554 and a single slot 552. It is also possible to have only slots 552 or only compartments 554. In one embodiment, slots 552 are sized to hold standard wallet size cards, such as credit cards, debit cards, insurance cards, retail cards, cash (coin or paper), gasoline cards, club cards, airline cards and the like. Compartment 554 can be sized to hold bigger items.

It is also possible that one or more compartments 554 and one or more slots 522 are provided on the inner surface of flap 548. Compartment 554 also includes in one embodiment a button or attachment mechanism 556, which can be of any of the types of attachment mechanisms discussed herein.

A relatively larger compartment 560 is provided on the outside of foldable member 542 of carrier 530. In one embodiment, compartment 560 is sized to hold a personal item or cell phone 28 snugly in place. A cover 562 folds over the top of the cell phone 28, preventing same from coming free from compartment 560. Although not illustrated, cover 562 attaches removably to compartment body 564 via one of the attachment mechanisms described herein. In one preferred embodiment, the cover 562 attaches via a magnetic snap to a carbon containing metal mating piece located on body 564.

In one embodiment, multiple personal item compartments are provided on the outside of foldable member 542. For example, a pen or pencil holder 566 is provided on the side 568 of body 564. Carrier 530 can be made of any of the materials described above for the other carriers. For example, the carrier 530 can be made primarily of leather or nylon. In one embodiment, the sides 568 and 570 of housing 564 are made of an expandable material, so as to more snugly hold one or more hold personal items, such as cell phone 28 therein. Because cell phones are provided in smaller and larger sizes, compartment 564 can be sized to hold any size cell phone. Compartment 564 can also be sized to hold additionally or alternatively, an email device a pager, a wallet, a passport, an airline ticket, a compact disk player, a compact disk, makeup, medicine, a credit/debit card, a driver's license, an airline card, an insurance card, a retail card, cash, a cigarette package, an address book, a digital music player (e.g. iPod™), an internet access device (e.g., a Blackberry™ device), a camera, a small television, an email access device, an electronic apparatus and any combination thereof.

In one embodiment, central section 544 defines one or more slots (not illustrated) along one of the longer sides of the center section 544, the other longer side making a seam with a second layer of central section 544. The additional slot(s) can extend substantially perpendicular to slots 552 and be provided behind slots 552 and compartment 554. The additional slot can be bigger than slots 552, for example, to hold sunglasses or any of the personal items described herein.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A personal item carrying device comprising:

a strap configured to be placed over a person and to extend from a first side of the person, along the front of the person, over the shoulder on a second side of the person, and return along the back of the person to the first side;

the strap adjustable via a member fixed to the strap at a first strap position and slidingly engaged to the strap at a second strap position;

the strap also including an opener that enables the strap to be opened and thereafter be placed around the person's midsection and adjusted via the member; and a carrier supported by the strap, the carrier sized to hold a personal item , wherein the carrier further comprises a center member, having longitudinal side edges and first and second sides, a first flap extending from a first longitudinal edge of the center member, a second flap extending from a second longitudinal edge of the center member, the first and second flaps configured to fold over the center member to cover the first side of the center member and around the strap to moveably secure the carrier to the strap, the center member when the first and second flaps are unfolded exposing the first side having a plurality of compartments sized to hold personal items, the carrier including at least one additional compartment located on the second side of the center member for holding a cellular phone, wherein the center member and the at least one additional compartment each comprises a cover that opens and closes to enable insertion and removal of the personal item or cellular phone.

2. The personal item carrying device of claim 1, which includes an assembly connected to end portions of the strap, the assembly including an attachment mechanism that connects the assembly to an item of apparel located substantially at the person's midsection.

3. The personal item carrying device of claim 2, wherein the opener is located between the end portions of the strap.

4. The personal item carrying device of claim 2, wherein the attachment mechanism is selected from the group consisting of: a spring clip, a lock, a hook and any combination thereof.

5. The personal item carrying device of claim 2, wherein the attachment mechanism is removable from the assembly.

6. The personal item carrying device of claim 1, wherein the opener includes an apparatus selected from the group consisting of: a buckle, a snap-fitting apparatus, a button, a magnetic device, a clip, a frictionally securing device and any combination thereof.

7. The personal item carrying device of claim 1, wherein the carrier is slideably held by the strap.

8. The personal item carrying device of claim 1, wherein the carrier defines at least one aperture that receives the strap.

9. The personal item carrying device of claim 1, wherein the first and second flaps include an attachment device that attaches the flaps to one another.

10. The personal item carrying device of claim 1, wherein the carrier is sized and structured tp hold a plurality of personal items.

11. The personal item carrying device of claim 1, wherein the personal item is selected from the group consisting of: a cell phone, a pager, a wallet, a passport, an airline ticket, a compact disk player, a compact disk, makeup, medicine, a credit/debit card, a driver's license, an airline card, an insurance card, a retail card, cash, a cigarette package, an address book, a digital music player, an internet access device, a camera, a small television, an email access device, an electronic apparatus and any combination thereof.

12. The personal item carrying device of claim 1, wherein at least one of the strap and the carrier is made from a material selected from the group consisting of: leather, suede, cowhide, fur, fabric, a polymer, a polymer weave, nylon, a meshed material, a woven material and any combination thereof.

13. A personal item carrying device comprising:

a strap sized to extend from a first side of a person, along the front of a person, over the shoulder on a second side of the person, and return along the back of the person to the first side;

the strap including (i) a quick release mechanism and (ii) an adjustment member fixed to the strap at a first strap position and slidingly engaged to the strap at a second strap position, so that the strap is openable and adjustable to fit over the person's shoulder and around the person's midsection; and a caddy moveably supported by the strap, the caddy sized to hold a personal item, wherein the caddy further comprises a center member having a middle portion, a first flap extending from a first side of the middle portion center member, a second flap extending from a second side of the middle portion center member, the first and second flaps configured to fold over the middle portion center member and around the strap to moveably secure the caddy to the strap, the center member when unfolded exposing a first side having a plurality of compartments sized to hold personal items, the caddy including at least one other compartment located on a second side of the first side of the center member, wherein the center member and the at least one other compartment further comprises a portion that opens and closes to enable insertion and removal of the personal item.

14. The personal item carrying device of claim 13, which includes means for securing end portions of the strap to an item of apparel worn at the person's midsection.

15. The personal item carrying device of claim 14, wherein the securing means includes a first portion attached to the ends of the straps and a second portion that is attached to the item of apparel.

16. A personal item carrying device comprising:

a strap configured to be placed over a person and to extend from a first side of the person, along the front of the person, over the shoulder on a second side of the person, and return along the back of the person to the first side;

the strap adjustable via a member fixed to the strap at a first strap position and slidingly engaged to the strap at a second strap position;

the strap also including an opener that enables the strap to be opened and thereafter be placed around the person's midsection and adjusted via the member;

a member supported by the strap including a middle portion, a first flap extending from a first side of the middle portion, a second flap extending from a second side of the middle portion, the first and second flaps operable to fold over an inside surface of the middle portion and around and coupled to the strap and releasably attach to each other, the inside surface of the middle portion of the member including multiple card holding slots; and an outside surface of the middle portion of the member including a compartment sized to securely hold a cellular phone, wherein the middle portion and the compartment each further comprises an attachment device that open and closes to enable insertion and removal of at least one of the cards and the cellular phone.

17. The personal item carrying device of claim 16, wherein the member further comprises an attachment mechanism selected from the group consisting of a spring clip, a lock, a hook and any combination thereof.

18. The personal item carrying device of claim 16, which includes a plurality of personal item holding compartments located on the outside side of the foldable member.

19. The personal item carrying device of claim 1, wherein the portion is selected from the group consisting of: a buckle, a snap, a button, a magnetic device, a clip, a frictionally securing device and any combination thereof.

20. The personal item carrying device of claim 13, wherein the portion that opens and closes is selected from the group consisting of: a buckle, a snap, a button, a magnetic device, a clip, a frictionally securing device and any combination thereof.

21. The personal item carrying device of claim 16, wherein the portion is selected from the group consisting of: a buckle, a snap, a button, a magnetic device, a clip, a frictionally securing device and any combination thereof.

22. The personal item carrying device of claim 16, wherein the attachment device is selected from the group consisting of: a buckle, a snap, a button, a magnetic device, a clip, a frictionally securing device and any combination thereof.

* * * * *